US007657211B2

(12) United States Patent
Kawai

(10) Patent No.: US 7,657,211 B2
(45) Date of Patent: Feb. 2, 2010

(54) IMAGE FORMING DEVICE INCLUDING A REMOVABLE DEVELOPER DISCHARGE UNIT

(75) Inventor: Hideaki Kawai, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 361 days.

(21) Appl. No.: 11/737,224

(22) Filed: Apr. 19, 2007

(65) Prior Publication Data

US 2007/0248384 A1 Oct. 25, 2007

(30) Foreign Application Priority Data

Apr. 25, 2006 (JP) ..... 2006-120813

(51) Int. Cl.
*G03G 15/08* (2006.01)
*G03G 21/00* (2006.01)

(52) U.S. Cl. ..... 399/260; 399/358

(58) Field of Classification Search ..... 399/119, 399/258, 260, 262, 263, 358–360
See application file for complete search history.

(56) References Cited

U.S. PATENT DOCUMENTS 5,734,953 A 3/1998 Tatsumi
5,828,935 A 10/1998 Tatsumi et al.
2002/0085857 A1* 7/2002 Kim et al. ..... 399/119

FOREIGN PATENT DOCUMENTS

JP 09-120203 A 5/1997
JP 2000-029309 A 1/2000

* cited by examiner

*Primary Examiner*—Hoang Ngo
(74) *Attorney, Agent, or Firm*—Keating & Bennett, LLP.

(57) ABSTRACT

An image forming device includes a device main body having a developer receiving port, and a developer discharge unit having a developer discharge port. When the developer discharge unit is attached to the device main body, the developer receiving port and the developer discharge port overlap each other. As the developer discharge unit is attached to the device main body, a shutter opens in a direction that is different from an attaching direction of the developer discharge unit. The developer discharge port of the developer discharge unit is opened accompanying an opening movement of the shutter, and an opening portion of the developer discharge port and an opening portion of the developer receiving port overlap each other at all times.

19 Claims, 8 Drawing Sheets

PRIOR ART PRIOR ART PRIOR ART

IMAGE FORMING DEVICE INCLUDING A REMOVABLE DEVELOPER DISCHARGE UNIT

BACKGROUND OF THE INVENTION

1. Field of the Invention

The present invention relates to an image forming device. More specifically, the present invention relates to an image forming device including a toner discharge unit which can be removably attached to a device main body.

2. Description of the Related Art

An image forming device is used as a scanner, a facsimile machine, a copier, and a Multi Function Peripheral (MFP) of the scanner, the facsimile machine, and/or the copier. In the image forming device, a surface of a charged photoconductive drum is exposed according to image information, and an electrostatic latent image is formed. The electrostatic latent image is developed, and a toner image is formed. The toner image is transferred onto a printing paper, and accordingly, an image forming operation is performed.

When the electrostatic latent image is developed, and the toner image is formed, toner charged in a developing unit is transferred from a developing roller to the surface of the photoconductive drum. Accordingly, since the toner in the developing unit decreases each time the toner image is formed, toner is required to be regularly supplied to the developing unit. Since the toner is regularly supplied to the developing unit, a toner supply unit, which is a toner discharge unit, is provided in a device main body.

The toner supply unit can be removably attached to the device main body. When the toner supply unit is attached to the device main body, a toner discharge port of the toner supply unit and a toner receiving port of the developing unit overlap each other. Moreover, a shutter, which slides and can be opened and closed, is respectively attached to the toner discharge port and the toner receiving port. When the toner supply unit is attached to the device main body, both of the shutters slide so that the toner discharge port is opened under a state in which the toner receiving port is opened. When both of the shutters move to a position where the shutters open the toner discharge port and the toner receiving port, the toner is discharged into the developing unit. Thus, the toner discharged from the toner discharge port can be prevented from not being received in the developing unit and scattering. As a result, an inside of the image forming device is not contaminated.

The toner transferred onto the surface of the photoconductive drum forms the toner image. A portion of the formed toner image is not transferred onto the printing paper, and remains as residual toner on the surface of the photoconductive drum. Accordingly, a cleaning device, which is the toner discharge unit, is provided in the device main body. The cleaning device scrapes off the residual toner remaining on the surface of the photoconductive drum. A residual toner receiving unit is provided in the device main body. The residual toner receiving unit receives the residual toner discharged from the cleaning device.

The cleaning device can be removably attached to the device main body. When the cleaning device is attached to the device main body, a toner discharge port of the cleaning device and a toner receiving port of the residual toner receiving unit overlap each other. Moreover, a shutter, which slides and can be opened and closed, is respectively attached to the toner discharge port and the toner receiving port. Accompanying an attaching operation of the cleaning device to the device main body, the shutters slide so that the toner discharge port is opened under a state in which the toner receiving port is opened. When both of the shutters move to a position where the shutters open the toner discharge port and the toner receiving port, the residual toner is discharged into the residual toner receiving unit. Thus, the residual toner discharged from the toner discharge port can be prevented from not being received in the residual toner receiving unit of the device main body and scattering. As a result, an inside of the image forming device is not contaminated. Some conventional image forming devices are provided with two slide plates. One of the slide plates is urged in a direction in which the slide plate closes a discharge port of a toner cartridge, and the other slide plate is urged in a direction in which the latter slide plate closes a receiving port of the developing unit.

Generally, the slide plate provided to the discharge port of the toner cartridge opens and closes in the same direction as a direction in which the toner cartridge is attached to the device main body. However, due to limitations of a layout of the image forming device, in some cases, a direction in which the shutter of the toner discharge port opens and closes may need to be different from a direction in which the toner discharge unit is attached to the developing unit or the device main body. FIGS. 8A, 8B, and 8C are schematic top views of the conventional image forming device including the above-described configuration. In FIGS. 8A, 8B, and 8C, a toner supply unit 40 includes a toner discharge port 41 and a shutter 42. The toner supply unit 40 can be attached such that the toner supply unit 40 slides parallel to a developing unit 50 including a toner receiving port 51. The shutter 42 opens to a right side with respect to a direction in which the toner supply unit 40 is attached. In the image forming device having such a shutter, an opening direction of the shutter 42 of the toner discharge port 41 and the attaching direction of the toner supply unit 40 differ from each other. Moreover, the toner discharge port 41 is square-shaped. Therefore, as illustrated in FIG. 8B, a non-overlapped portion 41A, which does not overlap the toner receiving port 51 of the developing unit 50, occurs at a portion of an opening of the toner discharge port 41, which is opened when the shutter 42 opens. Accordingly, a problem is that since the toner discharged from the toner discharge port 41 is not received in the toner receiving port 51 of the developing unit 50 and scatters, an inside of the image forming device is contaminated.

SUMMARY OF THE INVENTION

In order to overcome the problems described above, preferred embodiments of the present invention provide an image forming device in which toner discharged from a toner discharge port can be prevented from not being received in a device main body of the image forming device and scattering. As a result, an inside of the image forming device is not contaminated.

According to a preferred embodiment of the present invention, an image forming device includes a device main body and a toner discharge unit. The toner discharge unit can slide and be removably attached to the device main body. The toner discharge unit can be attached to the device main body at a position where a toner discharge port overlaps a toner receiving port of the device main body. The toner discharge unit includes a shutter at a lower portion thereof. Accompanying sliding movement of the toner discharge unit, the shutter opens in a direction that is different from a direction in which the toner discharge unit slides. The toner discharge port is opened as the shutter opens, and at this time, an opening portion of the toner discharge port overlaps an opening portion of the toner receiving port at all times.

According to the present preferred embodiment of the present invention, even when the shutter of the toner discharge port opens and closes in the direction that is different from the direction in which the toner discharge unit slides, the toner discharge port does not open at a position displaced from the opening portion of the toner receiving port. In addition, the toner discharged from the toner discharge port can be prevented from not being received in the device main body of the image forming device and scattering. As a result, the inside of the image forming device is not contaminated.

According to preferred embodiments of the present invention, preferably, the toner discharge port is preferably substantially triangle-shaped or has a shape including an arc.

According to the preferred embodiment of the present invention, compared with a conventional square-shaped toner discharge port, the opening portion of the toner discharge port is small. Therefore, an intensity of a main body of the toner discharge unit increases.

According to a preferred embodiment of the present invention, the toner receiving port is provided with the shutter. The shutter of the toner receiving port preferably opens accompanying the sliding movement of the toner discharge unit to the device main body.

According to the preferred embodiments of the present invention, only when the toner discharge unit is attached, the toner receiving port is opened. Accordingly, a contaminated object from outside can be prevented from entering the device main body of the image forming device.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
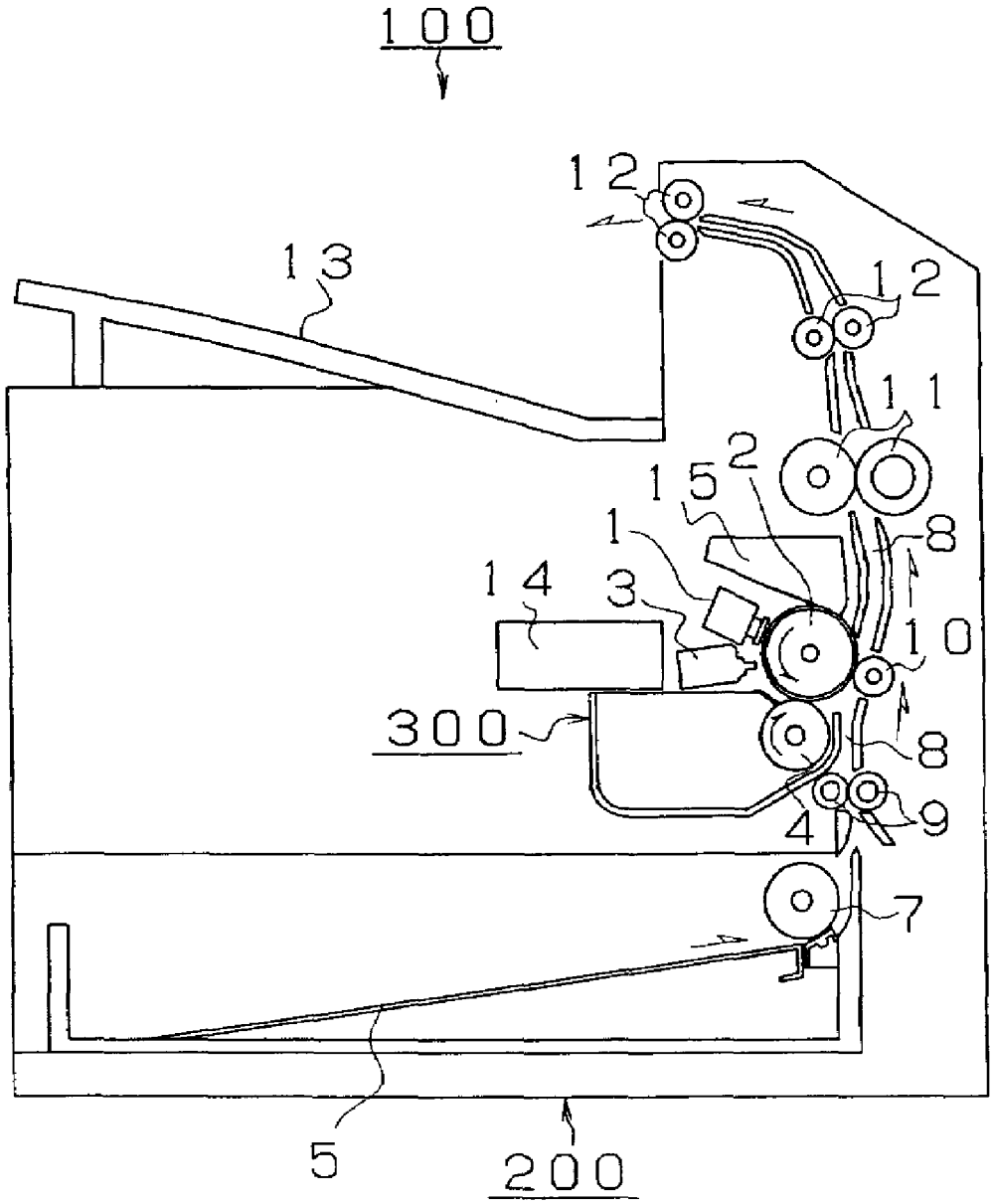
FIG. 1 illustrates an inner configuration of an image forming device according to a preferred embodiment of the present invention.
Figure 2:
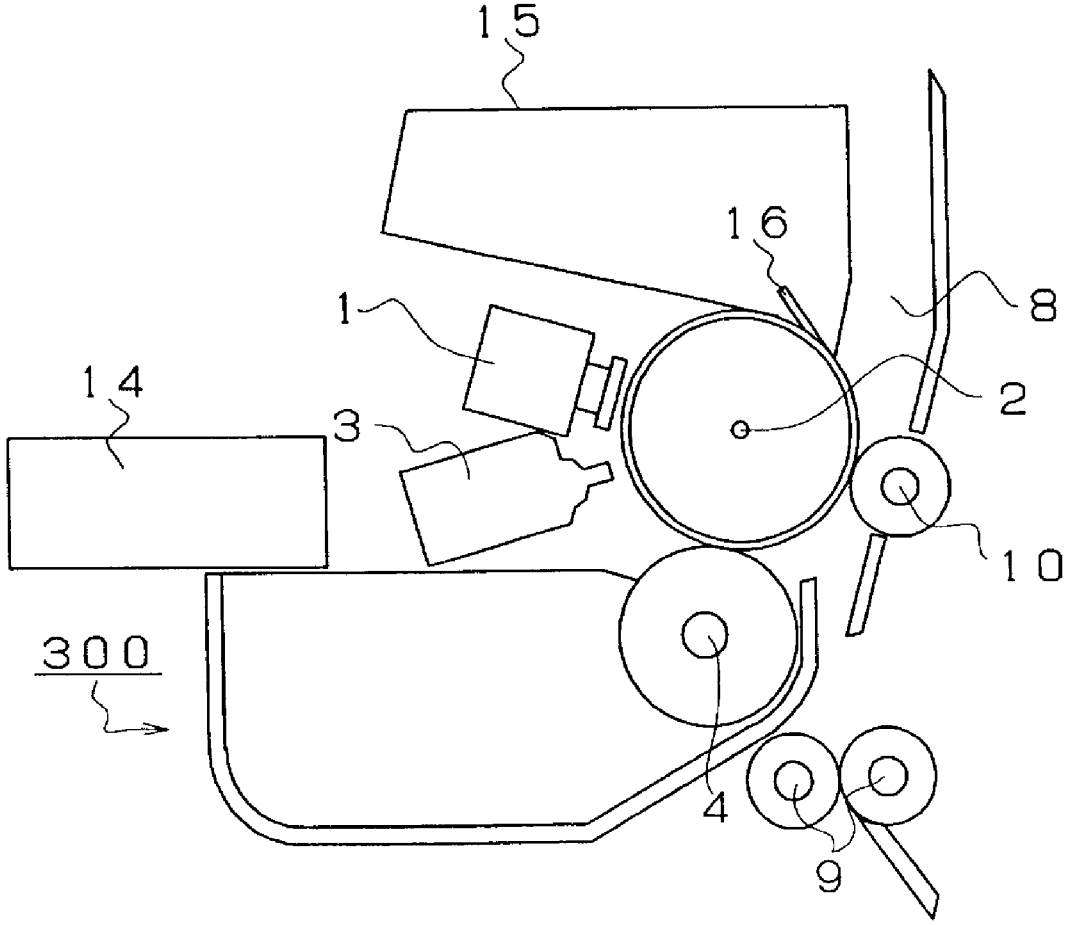
FIG. 2 illustrates a developing unit.

A description will be made of an image forming device 100 according to preferred embodiments of the present invention with reference to the drawings. FIG. 1 is a schematic longitudinal sectional view illustrating an inner configuration of the image forming device 100. FIG. 2 is a schematic longitudinal sectional view of a developing unit 300.

In the image forming device 100, a surface of a photoconductive drum 2 is uniformly charged by a charging unit 1. A Light Emitting Diode (LED) head 3 exposes the surface of the charged photoconductive drum 2 according to image information, and an electrostatic latent image is formed. A developing roller 4 develops the electrostatic latent image into a toner image, and accordingly, a visible image is formed. The toner image is formed by toner (as developer), which has been transferred from the developing roller 4 of a developing unit 300 to the surface of the photoconductive drum 2. Meanwhile, when an image forming operation is started, a printing paper stacked on a paper feed tray 5 is picked up by a pick up roller 7 and transported into a transportation path 8. A transportation roller 9 is accordingly arranged on the transportation path 8. The transportation roller 9 transports the printing paper along the transportation path 8 to the photoconductive drum 2. The printing paper, which has been transported to the photoconductive drum 2, is pressed against the photoconductive drum 2 by a transfer roller 10. Voltage having a polarity opposite from a polarity of the toner image on the photoconductive drum 2 is impressed onto the transfer roller 10. Thus, the toner image on the surface of the photoconductive drum 2 is transferred onto the printing paper. The printing paper, on which the toner image is transferred, is transported downstream along the transportation path 8. A fuser roller 11, which has a heater therein, presses and heats the printing paper, and the toner on the printing paper is fixed onto the printing paper. The toner-fixed printing paper is discharged onto a discharge tray 13 by an exit roller 12.

The image forming device 100 includes a device main body 200, the developing unit 300, and a toner discharge unit. According to the preferred embodiments of the present invention, the toner discharge unit preferably includes a toner supply unit 14 and a cleaning device 15. As illustrated in FIG. 2, the toner supply unit 14 is arranged on an upper portion of the developing unit 300. The developing unit 300 is fixedly attached to the device main body 200. The toner supply unit 14 can slide and be removably attached to the developing unit 300 and the device main body 200. The toner is discharged from the toner supply unit 14 to the developing unit 300 as required. The discharged toner is transferred to the developing roller 4 by a screw and a paddle (not illustrated), which are provided in the developing unit 300. As illustrated in FIG. 2, the cleaning device 15 is arranged on an upper portion of the photoconductive drum 2. The cleaning device 15 preferably includes a cleaning blade 16. The cleaning blade 16 scrapes off the residual toner remaining on the surface of the photoconductive drum 2 after the transfer. The cleaning device 15 can also slide and be removably attached to the device main body 200. The residual toner, which has been scraped off the surface of the photoconductive drum 2 by the cleaning blade 16, is discharged to a residual toner receiving unit 19.

Figure 3:
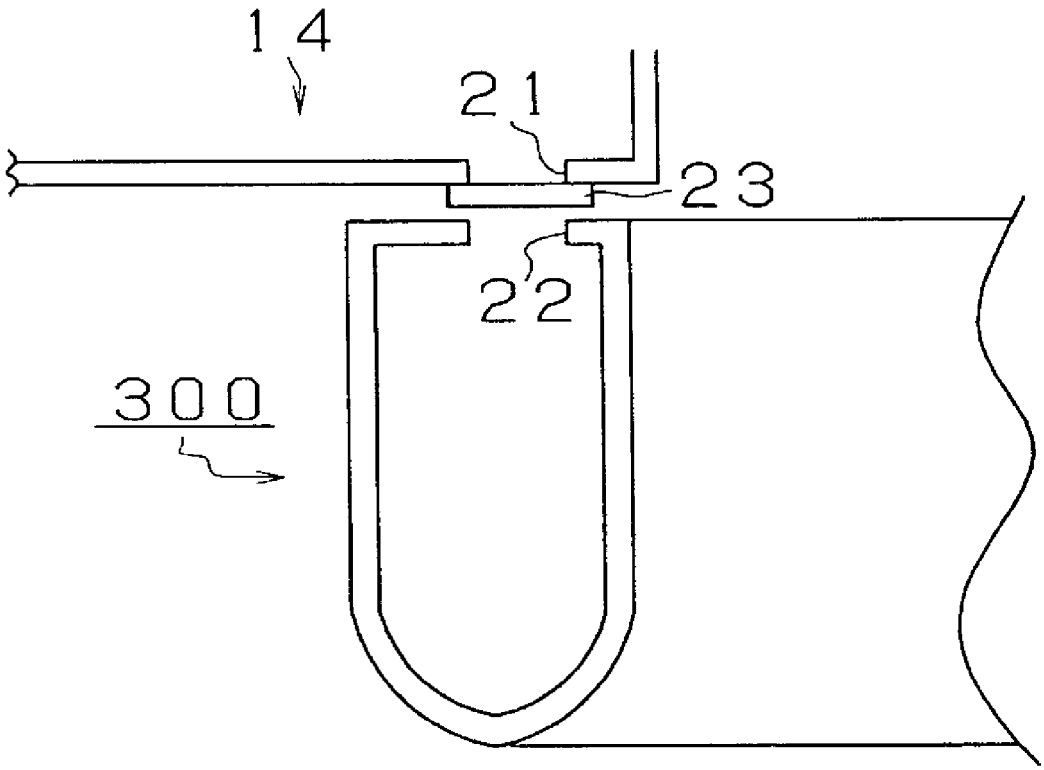
FIG. 3 illustrates a toner supply unit and a developing unit in a state in which the toner supply unit is attached to the developing unit.

As illustrated in FIG. 3, when the toner supply unit 14 is connected to the developing unit 300, a toner discharge port 21 of the toner supply unit 14 and a toner receiving port 22 of the developing unit 300 overlap each other. The toner discharge port 21 is arranged on a lower surface of the toner supply unit 14. A shutter 23 opens and closes the toner discharge port 21. The developing unit 300 includes the toner receiving port 22 and a shutter (not illustrated). The shutter opens and closes the toner receiving port 22. The developing unit 300 receives the toner, which is discharged from the toner supply unit 14, at the toner receiving port 22.

Figure 4:
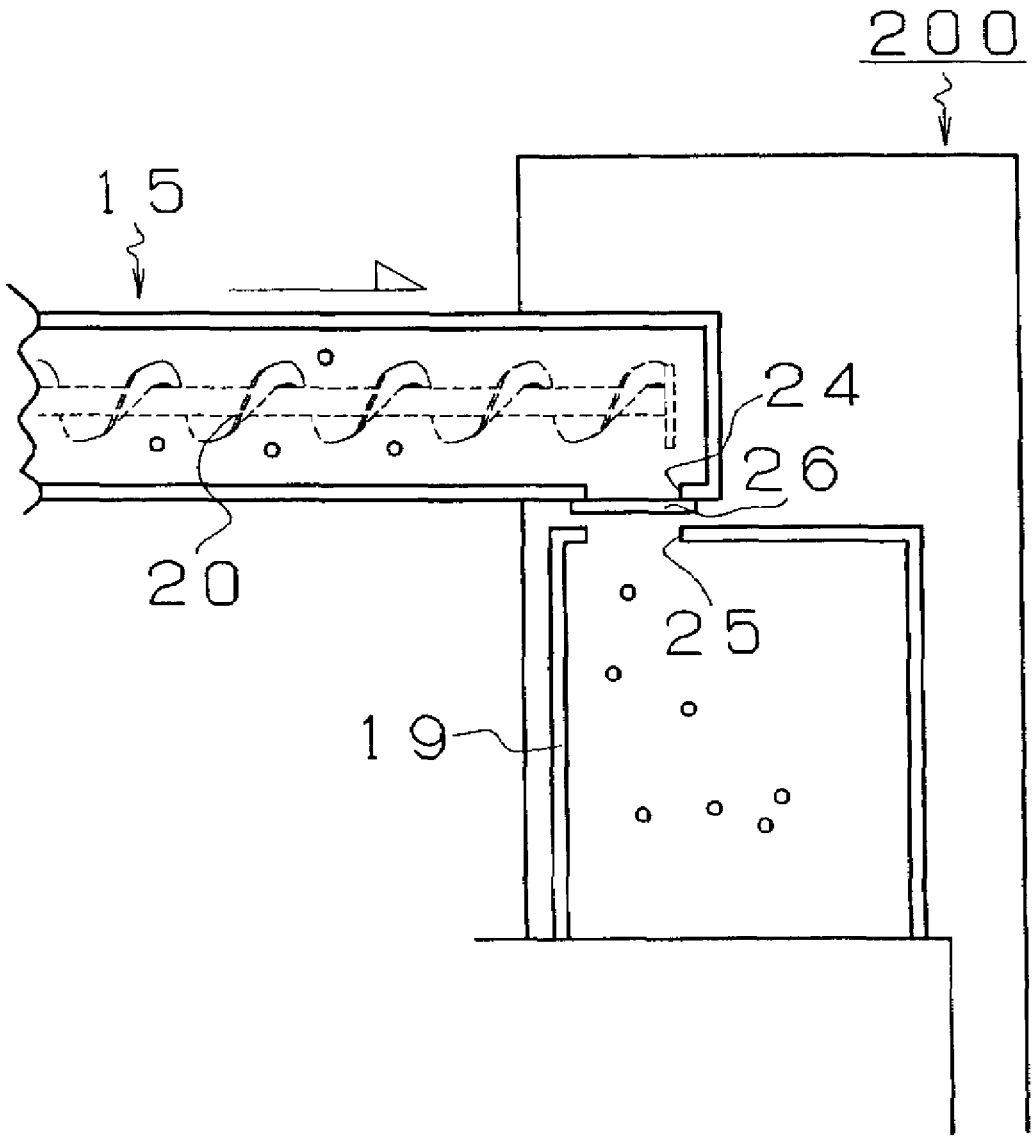
FIG. 4 illustrates a cleaning device and a device main body in a state in which the cleaning device is attached to the device main body.

As illustrated in FIG. 4, the cleaning device 15 preferably includes a screw 20 therein. When the cleaning device 15 is connected to the device main body 200, a toner discharge port 24 of the cleaning device 15 and a toner receiving port 25 of the residual toner receiving unit 19 overlap each other. The screw 20 transports the residual toner, which has been scraped off the surface of the photoconductive drum 2 by the cleaning blade 16, to the residual toner receiving unit 19. The toner discharge port 24 is arranged on a lower surface of the cleaning device 15. A shutter 26 opens and closes the toner discharge port 24. The residual toner receiving unit 19 includes the toner receiving port 25 and a shutter (not illustrated). The shutter opens and closes the toner receiving port 25. The residual toner receiving unit 19 receives the residual toner, which is discharged from the cleaning device 15, at the toner receiving port 25.

A description will be made of a shutter mechanism of the toner discharge unit in the image forming device 100 according to the preferred embodiments of the present invention. FIGS. 5A-5E are schematic longitudinal sectional views illustrating the toner supply unit 14 and the developing unit 300 in various states including one in which the toner supply unit 14, which is the toner discharge unit in the image forming device 100, is being attached to the developing unit 300. FIGS. 6A-6E are schematic top views of the toner supply unit 14 and the developing unit 300 in various states including a state in which the toner supply unit 14 in the image forming device 100 is being attached to the developing unit 300.

The toner supply unit 14 includes the toner discharge port 21 and the shutter 23 on a bottom wall thereof. As illustrated in FIGS. 6A-6E, the toner discharge port 21 is preferably substantially triangle-shaped. According to the preferred embodiments of the present invention as illustrated in FIGS. 6A-6E, the shutter 23 is preferably substantially square-shaped. However, the shutter 23 is not limited to such shape and may have other shapes that can cover the toner discharge port 21 entirely. A protruding portion 27, which protrudes downward, is preferably integral with the shutter 23. As illustrated in FIGS. 5A-5E, the protruding portion 27 of the shutter 23 can make contact with a protruding portion 29 of a casing to be described below, and has a height which does not make contact with a wall surface portion of the developing unit 300. Moreover, a surface of the protruding portion 27 of the shutter 23, which makes contact with the protruding portion 29 of the casing, is arranged at a prescribed angle with respect to an attaching direction (in the direction of arrow G) of the toner supply unit 14 to the developing unit 300. The prescribed angle of the protruding portion 27 of the shutter 23 determines a timing to open the shutter 23. A coil spring is connected to the shutter 23. The shutter 23 is closed by stretching force of the coil spring (not illustrated).

The developing unit 300 includes the toner receiving port 22, a shutter 28, and the protruding portion 29, which protrudes upward. As illustrated in FIGS. 6A-6E, the toner receiving port 22 is preferably substantially square-shaped. According to the preferred embodiments of the present invention, the shutter 28 is preferably substantially square-shaped. However, the shutter 28 is not limited to such shape and may have other shapes that can cover the toner receiving port 22 entirely. A protruding portion 30, which protrudes upward, is integrally formed on the shutter 28. As illustrated in FIGS. 5A-5E, the protruding portion 30 of the shutter 28 has a height which can make contact with a wall surface on a front side of the toner supply unit 14 in the attaching direction thereof. A width of the protruding portion 30 of the shutter 28 is not specifically limited, but is sufficient to make contact with the wall surface on the front side of the toner supply unit 14 in the attaching direction thereof. As illustrated in FIGS. 5A-5E, the protruding portion 29 of the casing is fixedly arranged on an upper wall of the casing of the developing unit 300. The protruding portion 29 of the casing has a height which can make contact with the protruding portion 27 of the shutter 23 and does not make contact with the shutter 23. A shape of the protruding portion 29 of the casing is not specifically limited, but is preferably substantially cylindrical in the present preferred embodiment of the present invention. A coil spring 31 is connected to the shutter 28. The shutter 28 is closed by stretching force of the coil spring 31.

Figure 5A:
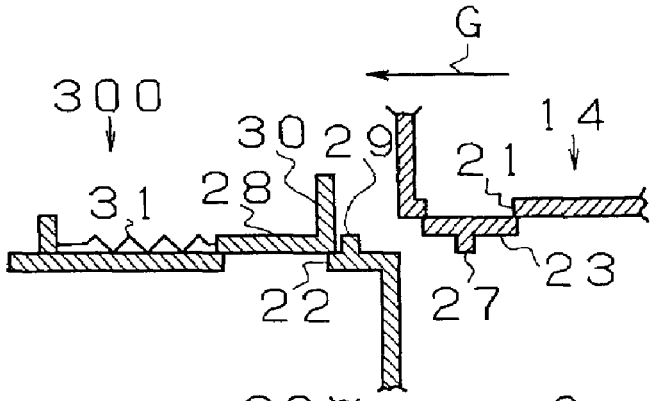
FIGS. 5A, 5B, 5C, 5D, and 5E illustrate a toner supply unit and a developing unit in a state in which the toner supply unit is being attached to the developing unit.
Figure 5B:
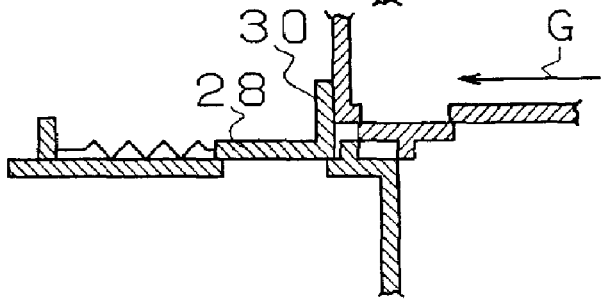
Figure 5C:
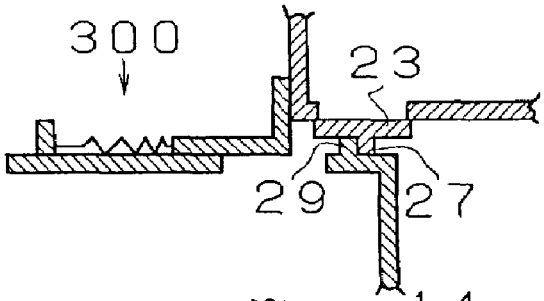
Figure 5D:
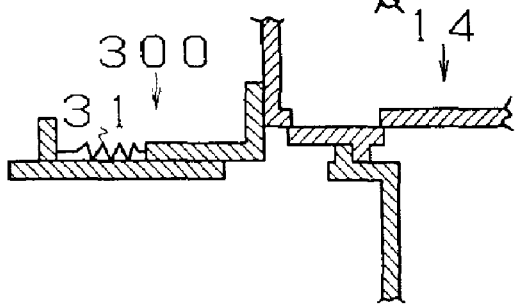
Figure 6A:
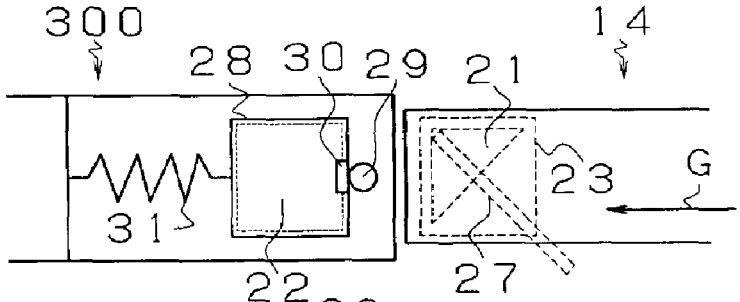
FIGS. 6A, 6B, 6C, 6D, and 6E are top views of a toner supply unit and a developing unit in a state in which the toner supply unit is being attached to the developing unit.
Figure 6B:
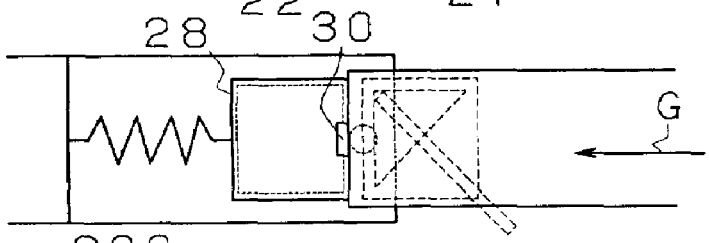
Figure 6C:
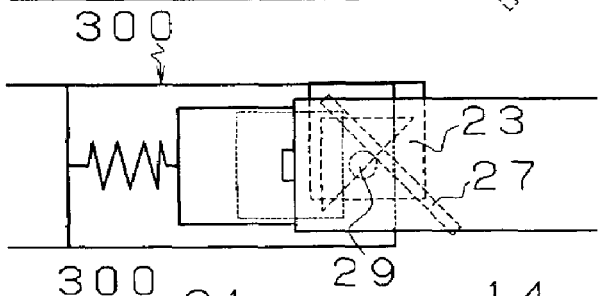
Figure 6D:
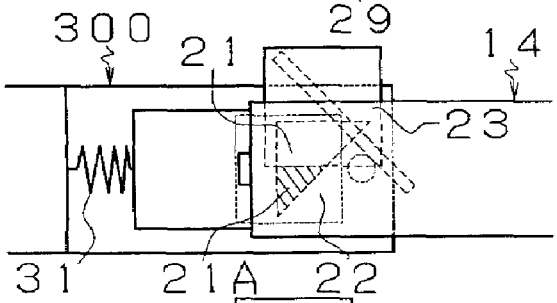
Figure 6E:
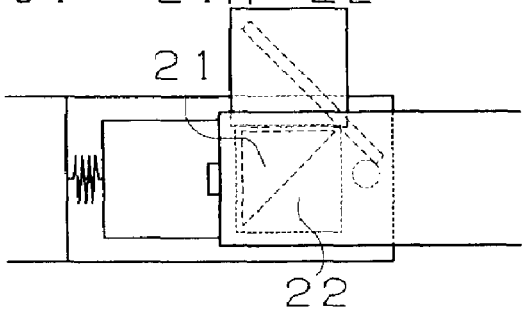
Figure 7A:
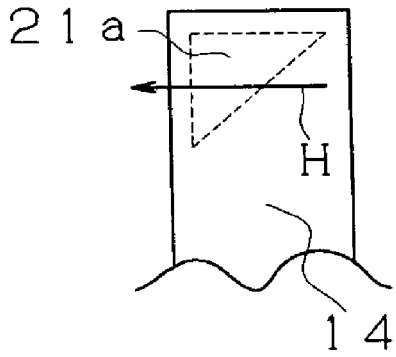
FIGS. 7A, 7B, 7C, and 7D illustrate a shape of a toner discharge port of a toner supply unit.
Figure 7B:
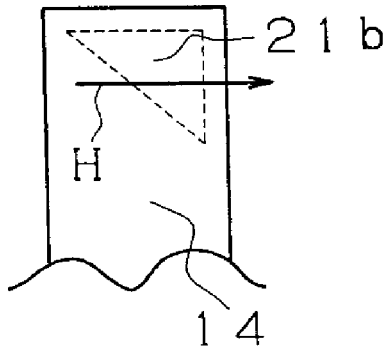
Figure 7C:
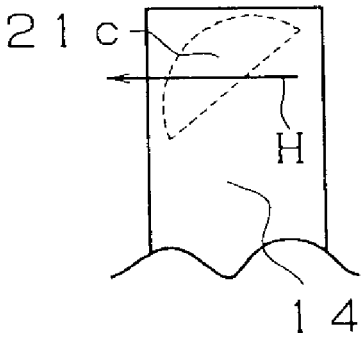
Figure 7D:
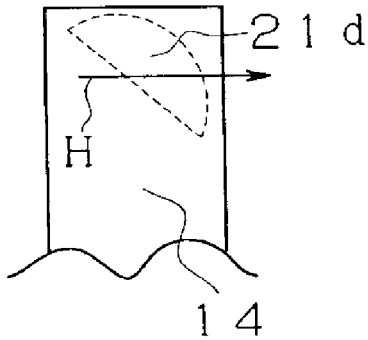
Figures 8A, 8B, 8C:
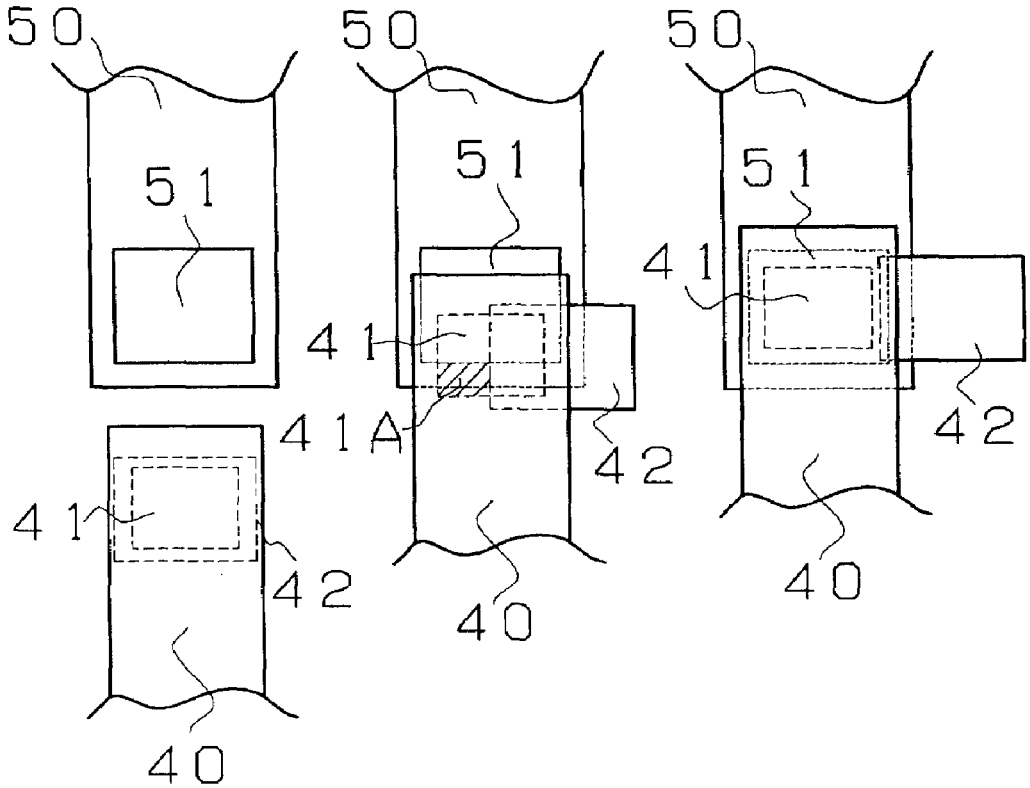
FIGS. 8A, 8B, and 8C are views for explaining problems to be overcome by the present invention.

When attaching the toner supply unit 14 to the developing unit 300, the toner supply unit is slid in a direction of the arrow G. When the toner supply unit 14 is slid, a wall surface portion of the toner supply unit 14 makes contact with the protruding portion 30 of the shutter 28 (FIG. 5B). The protruding portion 30 of the shutter 28 is pressed by the toner supply unit 14, and the shutter 28 moves. When the toner supply unit 14 is slid further, the protruding portion 27 of the shutter 23 makes contact with the protruding portion 29 of the casing of the developing unit 300 (FIG. 5C). As described above, a contacting surface of the protruding portion 27 of the shutter 23 with the protruding portion 29 of the casing is arranged at the prescribed angle with respect to the attaching direction of the toner supply unit 14 into the developing unit 300. The toner supply unit 14 is attached under a state in which the protruding portion 29 of the casing and the protruding portion 27 of the shutter 23 are in contact with each other. Therefore, as illustrated in FIG. 6D, the shutter 23 opens in a right direction (in an upward direction in FIG. 6D) with respect to an axial plane in which an axis thereof is the attaching direction of the toner supply unit 14. The shutter 23 opens along a rail (not illustrated) on the toner supply unit 14, and is closed by the stretching force of the coil spring 31. When the toner supply unit 14 is attached to the developing unit 300, the toner discharge port 21 is opened as the shutter 23 opens, and an opening portion 21A (a shaded area in FIG. 6D) of the toner discharge port 21 overlaps an opening portion of the toner receiving port 22 at all times. Accordingly, the toner discharged from the toner discharge port 21 can be prevented from being unreceived in the developing unit 300 and scattering. As a result, an inside of the image forming device 100 is not contaminated. The toner supply unit 14 is slid to a position where the entire toner discharge port 21 overlaps the toner receiving port 22 (FIG. 6E).

Figure 5E:
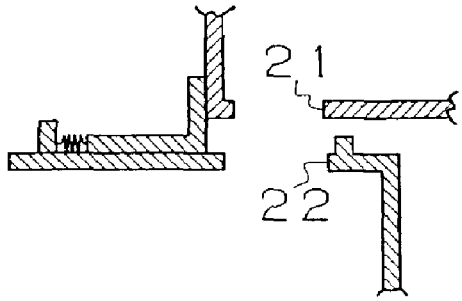

Accompanying sliding movement of the toner supply unit 14, the protruding portion 30 of the shutter 28 is pressed in the attaching direction of the toner supply unit 14, and accordingly, the shutter 28 opens. When the toner supply unit 14 is slid to the position where the entire toner discharge port 21 overlaps the toner receiving port 22, the toner receiving port 22 is opened fully (FIG. 5E). In other words, only when the toner supply unit 14 is attached, the toner receiving port 22 is opened.

When the toner supply unit 14 is removed from the developing unit 300, the toner supply unit 14 is slid in a direction opposite from the direction of the arrow G. By sliding the toner supply unit 14 in the direction opposite from the direction of the arrow G, the shrunk coil spring stretches, and the shutters 23 and 26 are closed.

FIGS. 7A-7D are schematic views illustrating a shape of the toner discharge port 21 of the toner supply unit 14. An arrow H indicates an opening direction of the shutter 23, which opens and closes the toner discharge port 21. The toner discharge port 21 is preferably substantially triangle-shaped or has a shape including an arc. For example, the toner discharge port 21 can be shaped as illustrated in FIGS. 7A, 7B, 7C, and 7D.

Toner discharge ports 21*a* and 21*b* are preferably substantially triangle-shaped. The toner discharge port 21*a* is opened such that a square corner thereof is positioned in a left direction, which is the same direction as an opening direction of the shutter 23. The toner discharge port 21*b* is opened such that a square corner thereof is positioned in a right direction, which is the same direction as an opening direction of the shutter 23. Since the toner discharge port 21 is opened as the toner discharge ports 21*a* and 21*b* are opened, even when the shutter 23 slides in a direction different from the attaching direction of the toner supply unit 14, the opening portion 21A and the toner receiving port 22 overlap each other at all times. Thus, the toner discharged from the toner discharge port 21 can be prevented from not being received in the developing unit 300 and scattering. As a result, the inside of the image forming device 100 is not contaminated. Moreover, conventionally, the opening portion of the toner discharge port is preferably substantially square-shaped. However, by forming the substantially triangle-shaped opening portion according to the present preferred embodiment, compared with the conventional square-shaped opening portion of the toner discharge port, the opening portion of the discharge port is small. Therefore, intensity of a main body of the toner supply unit 14 increases.

Toner discharge ports 21*c* and 21*d* preferably have a shape including an arc. The toner discharge port 21*c* is opened such that the arc is positioned in a left direction, which is the same direction as an opening direction of the shutter 23. The toner discharge port 21*d* is opened such that the arc is positioned in a right direction, which is the same direction as an opening direction of the shutter 23. Since the toner discharge port 21 is opened as the toner discharge ports 21*c* and 21*d* are opened, even when the shutter 23 slides in a direction different from the attaching direction of the toner supply unit 14, the opening portion 21A and the toner receiving port 22 overlap each other at all times. Thus, the toner discharged from the toner discharger port 21 can be prevented from not being received in the developing unit 300 and scattering. As a result, the inside of the image forming device 100 is not contaminated. Moreover, conventionally, the opening portion of the toner discharge port is square-shaped. However, by forming the opening portion including the arc according to the present preferred embodiment, compared with the conventional square-shaped toner discharge port, the opening portion of the discharge port is small. Therefore, intensity of the main body of the toner supply unit 14 increases.

A shutter mechanism according to the above-described preferred embodiments has been described with regard to the toner supply unit 14 and the developing unit 300. However, the present invention can be similarly applied to a shutter mechanism between the cleaning device 15 and the device main body 200. In other words, the toner discharge port 24 of the cleaning device 15 preferably has a similar shape to the shape of the toner discharge port 21 of the toner supply unit 14, and the shutter 26 of the cleaning device 15 preferably has a similar shape and performs a similar operation to the shape and operation of the shutter 23 of the toner supply unit 14.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. An image forming device comprising:

a device main body including a developer receiving port which includes an opening arranged to receive developer; and a developer discharge unit arranged to be removably attached to the device main body, and including a developer discharge port which includes an opening arranged to discharge the developer and a shutter arranged to open and close the developer discharge port; wherein when the developer discharge unit is attached to the device main body, the developer receiving port and the developer discharge port overlap each other;

the shutter of the developer discharge unit is arranged such that, as the developer discharge unit is attached to the device main body by moving the developer discharge unit in a substantially linear attaching direction, the shutter moves in a substantially linear direction that is different from the substantially linear attaching direction of the developer discharge unit; and the developer discharge port of the developer discharge unit is opened accompanying an opening movement of the shutter, and an opening portion of the developer discharge port and an opening portion of the developer receiving port overlap each other at all times.

2. The image forming device according to claim 1, wherein the developer discharge port is substantially triangle-shaped.

3. The image forming device according to claim 1, wherein a shape of the developer discharge port includes an arc.

4. The image forming device according to claim 1, wherein the device main body includes a shutter arranged to open and close the developer receiving port, and the shutter of the developer receiving port opens as the developer discharge unit is attached to the device main body.

5. The image forming device according to claim 1, wherein the developer discharge unit includes a developer supply unit arranged to supply the developer to the device main body.

6. The image forming device according to claim 1, wherein the developer discharge unit includes a cleaning device arranged to scrape off residual developer remaining on a surface of a photoconductive drum.

7. The image forming device according to claim 1, wherein both the developer discharge port and the shutter are arranged on a lower portion of the developer discharge unit.

8. The image forming device according to claim 1, wherein the shutter of the developer discharge unit is substantially square shaped.

9. The image forming device according to claim 1, further comprising a coil spring attached to the shutter of the developer discharge unit to close the shutter via a stretching force of the coil spring.

10. An image forming device comprising:

a device main body;

a developing unit which is fixedly attached to the device main body, and includes a developer receiving port which includes an opening arranged to receive developer; and a developer discharge unit arranged to be removably attached to the device main body, and including a developer discharge port which includes an opening arranged to discharge the developer and a shutter arranged to open and close the developer discharge port; wherein when the developer discharge unit is attached to the device main body, the developer receiving port and the developer discharge port overlap each other;

the shutter of the developer discharge unit is arranged such that, as the developer discharge unit is attached to the device main body by moving the developer discharge unit in a substantially linear attaching direction, the shutter opens in a substantially linear direction that is different from the substantially linear attaching direction of the developer discharge unit; and the developer discharge port of the developer discharge unit is opened accompanying an opening movement of the shutter, and an opening portion of the developer discharge port and an opening portion of the developer receiving port overlap each other at all times.

11. The image forming device according to claim 10, wherein the developer discharge port is substantially triangle-shaped.

12. The image forming device according to claim 10, wherein a shape of the developer discharge port includes an arc.

13. The image forming device according to claim 10, wherein the developing unit includes a shutter arranged to open and close the developer receiving port, and the shutter of the developer receiving port opens as the developer discharge unit is attached to the device main body.

14. The image forming device according to claim 10, wherein the developer discharge unit includes a developer supply unit arranged to supply the developer to the device main body.

15. The image forming device according to claim 14, wherein the developing unit includes:

a first protruding portion, which protrudes upward and is fixed on a casing;

a second protruding portion arranged on the shutter of the developer supply unit such that the protruding portion protrudes downward; and a surface that makes contact with a third protruding portion provided on the developing unit is arranged at a prescribed angle with respect to an attaching direction of the developer supply unit, and when the developer supply unit is attached under a state in which the third protruding portion of the developing unit and the second protruding portion of the shutter of the developer supply unit are in contact with each other, the shutter of the developer supply unit opens in a direction different from the attaching direction of the developer supply unit.

16. The image forming device according to claim 15, wherein the third protruding portion of the developing unit is substantially cylindrical.

17. The image forming device according to claim 10, wherein both the developer discharge port and the shutter are arranged on a lower portion of the developer discharge unit.

18. The image forming device according to claim 10, wherein the shutter of the developer discharge unit is substantially square shaped.

19. The image forming device according to claim 10, further comprising a coil spring attached to the shutter of the developer discharge unit to close the shutter via a stretching force of the coil spring.

* * * * *